US008657641B2

(12) United States Patent
Burke

(10) Patent No.: US 8,657,641 B2
(45) Date of Patent: Feb. 25, 2014

(54) METHOD FOR FORMING AN ELECTRODE FOR A SPARK PLUG

(75) Inventor: Daniel S. Burke, Greer, SC (US)

(73) Assignee: Woodward Inc., Fort Collins, CO (US)

( * ) Notice: Subject to any disclaimer, the term of this patent is extended or adjusted under 35 U.S.C. 154(b) by 665 days.

(21) Appl. No.: 12/878,868

(22) Filed: Sep. 9, 2010

(65) Prior Publication Data

US 2011/0065350 A1 Mar. 17, 2011

Related U.S. Application Data

(60) Provisional application No. 61/241,583, filed on Sep. 11, 2009.

(51) Int. Cl.
*H01J 9/00* (2006.01)

(52) U.S. Cl.
USPC ..... 445/46

(58) Field of Classification Search
USPC ..... 445/46; 313/118–145
See application file for complete search history.

(56) References Cited

U.S. PATENT DOCUMENTS

| | | | |
|---|---|---|---|
| 1,538,750 | A | 5/1925 | Scognamillo |
| 1,596,240 | A | 8/1926 | Dikeman |
| 2,047,575 | A | 7/1936 | Burtnett |
| 2,208,030 | A | 7/1940 | Holmes |
| 2,776,394 | A | 2/1953 | Cuny et al. |
| 2,843,780 | A | 7/1958 | Harper, Jr. |
| 3,718,425 | A | 2/1973 | Weyl et al. |
| 3,958,144 | A | 5/1976 | Franks |
| 4,416,228 | A | 11/1983 | Benedikt et al. |
| 4,795,937 | A | 1/1989 | Wagner et al. |
| 4,901,688 | A | 2/1990 | Kashiwara et al. |
| 4,930,473 | A | 6/1990 | Dietrich |
| 4,963,784 | A | 10/1990 | Niessner |
| 4,987,868 | A | 1/1991 | Richardson |
| 5,014,656 | A | 5/1991 | Leptich et al. |
| 5,051,651 | A | 9/1991 | Kashiwara et al. |

(Continued)

FOREIGN PATENT DOCUMENTS

| | | |
|---|---|---|
| CA | 1010329 | 5/1977 |
| CA | 2320415 A1 | 3/2001 |

(Continued)

OTHER PUBLICATIONS

Maria-Emmanuella McCoole, M.Sc.E.E. et al.; Solutions for Improving Spark Plug Life in High Efficiency, High Power Density, Natural Gas Engines; Proceedings of ICES2006; ASME Internal Combustion Engine Division 2006 Spring Technical Conference; May 8-10, 2006, Aachen, Germany; ICES2006-1417; pp. 1-8.

(Continued)

*Primary Examiner* — Anh Mai
*Assistant Examiner* — Zachary J Snyder
(74) *Attorney, Agent, or Firm* — Reinhart Boerner Van Deuren P.C.

(57) ABSTRACT

A method of forming an electrode for a spark plug is provided. The method includes machining locating holes within a blank material, inserting a rod of a different material into the locating holes and brazing the rod to the blank. An electrode receiving aperture is machined into the blank. The step of machining the aperture exposes a surface of the rod to form a contact portion of the electrode.

20 Claims, 6 Drawing Sheets

(56) References Cited

U.S. PATENT DOCUMENTS

| | | | | |
|---|---|---|---|---|
| 5,369,328 | A | 11/1994 | Gruber et al. | |
| 5,421,300 | A | 6/1995 | Durling et al. | |
| 5,430,346 | A | 7/1995 | Johnson | |
| 5,554,908 | A | 9/1996 | Kuhnert et al. | |
| 5,555,862 | A | 9/1996 | Tozzi | |
| 5,619,959 | A | 4/1997 | Tozzi | |
| 5,623,179 | A | 4/1997 | Buhl | |
| 5,821,675 | A | 10/1998 | Suzuki | |
| 5,892,319 | A | 4/1999 | Rossi | |
| 5,947,076 | A | 9/1999 | Srinivasan et al. | |
| 6,013,973 | A | 1/2000 | Sato | |
| 6,060,822 | A | 5/2000 | Krupa et al. | |
| 6,064,144 | A | 5/2000 | Knoll et al. | |
| 6,130,498 | A | 10/2000 | Shimizu et al. | |
| 6,198,209 | B1 | 3/2001 | Baldwin et al. | |
| 6,326,719 | B1 | 12/2001 | Boehler et al. | |
| 6,460,506 | B1 | 10/2002 | Nevinger | |
| 6,533,629 | B1 * | 3/2003 | Boehler et al. | 445/7 |
| 6,611,083 | B2 | 8/2003 | LaBarge et al. | |
| 6,670,740 | B2 | 12/2003 | Landon, Jr. | |
| 6,676,468 | B2 * | 1/2004 | Ishiguro et al. | 445/7 |
| 7,104,245 | B2 | 9/2006 | Robinet et al. | |
| 7,615,914 | B2 | 11/2009 | Francesconi et al. | |
| 7,659,655 | B2 | 2/2010 | Tozzi et al. | |
| 2002/0094743 | A1 | 7/2002 | Harada | |
| 2002/0180326 | A1 | 12/2002 | Francesconi et al. | |
| 2004/0100179 | A1 | 5/2004 | Boley et al. | |
| 2005/0211217 | A1 | 9/2005 | Boley et al. | |
| 2006/0022565 | A1 | 2/2006 | Landon | |
| 2007/0236122 | A1 | 10/2007 | Borror | |
| 2007/0236125 | A1 * | 10/2007 | Lykowski et al. | 313/141 |
| 2007/0290593 | A1 | 12/2007 | Kowalski | |
| 2009/0189503 | A1 * | 7/2009 | Below | 313/141 |

FOREIGN PATENT DOCUMENTS

| | | | |
|---|---|---|---|
| CN | 2825995 | Y | 10/2006 |
| DE | 10144976 | A1 | 4/2003 |
| EP | 0675272 | A1 | 10/1995 |
| EP | 1441427 | A1 | 7/2004 |
| EP | 1976081 | A2 | 1/2008 |
| EP | 1556932 | B1 | 7/2008 |
| EP | 1950856 | A1 | 7/2008 |
| EP | 1965475 | A1 | 9/2008 |
| FR | 764079 | A | 5/1934 |
| FR | 985788 | A | 7/1951 |
| FR | 2071129 | A5 | 9/1971 |
| FR | 2131938 | B2 | 8/1979 |
| JP | 50077738 | A | 6/1975 |
| JP | 57-018283 | | 1/1982 |
| JP | 58-162719 | | 9/1983 |
| JP | H02148588 | U | 12/1990 |
| JP | 4133281 | | 5/1992 |
| JP | 4262388 | A | 9/1992 |
| WO | WO 92/02718 | A1 | 2/1992 |
| WO | WO 2004/107518 | A1 | 12/2004 |

OTHER PUBLICATIONS

Dr. Luigi Tozzi et al.; Advanced Combustion System Solutions for Increasing Thermal Efficiency in Natural Gas Engines While Meeting Future Demand for Low NOx Emissions; Proceedings of JRCICE2007; 2007 ASME/IEEE Joint Rail Conference & Internal Combustion Engine Spring Technical Conference; Mar. 13-16, 2006, Pueblo, Colorado USA; JRCICE2007-40026; pp. 1-7.

Jessica Adair et al.; Knock Characterization Using Ionization Detection; GMRC Gas Machinery Conference; Oklahoma City, Oklahoma; Oct. 2006; pp. 1-23.

Hironori Osamura, Development of Long Life and High Ignitability iridium Spark Plug, Technical Paper, Seoul 2000 FISITA World Automotive Congress; Jun. 12-15, 2000 Seoul, Korea; 6 pages.

Hironori Osamura, Development of New Iridium Alloy for Spark Plug Electrodes; SAE Technical Paper Series; 1999-01-0796; SI Engine Components and Technology (SP-1437); International Congress and Exposition Mar. 1-4, 1999; 14 pages.

U.S. Appl. No. 12/878,820, filed Sep. 9, 2010, Tozzi.

* cited by examiner

METHOD FOR FORMING AN ELECTRODE FOR A SPARK PLUG

CROSS-REFERENCE TO RELATED PATENT APPLICATIONS

This patent application claims the benefit of U.S. Provisional Patent Application No. 61/241,583, filed Sep. 11, 2009, the entire teachings and disclosure of which are incorporated herein by reference thereto.

FIELD OF THE INVENTION

This invention relates generally to methods of making pre-chamber spark plugs and more particularly to methods of making electrodes for use in pre-chamber spark plugs.

BACKGROUND OF THE INVENTION

Engines operating on gaseous fuels, such as natural gas, are commonly supplied with a lean fuel mixture, which is a mixture of air and fuel containing a relatively high ratio of air to fuel. The lean fuel mixture often results in misfires, detonation, incomplete combustion and poor fuel economy. One factor that can lead to such events is the poor ability of conventional spark plugs to effectively ignite a lean fuel mixture in the cylinder of the operating engine. More effective combustion of lean fuel mixtures can be achieved using a pre-combustion chamber.

Pre-chamber (i.e., pre-combustion chamber) spark plugs are typically used to enhance the flammability limits in engines such as natural gas burn engines. As in any spark plug, the pre-chamber spark plugs typically include a pair of electrodes including a ground electrode and a charged electrode. The ground electrode is annular shaped with the a plurality of radially inward projecting tips that surround the charged electrode. Consequently, the charged electrode generally extends axially into the charged electrode generally along a central axis defined by the annular ground electrode.

To extend spark plug life, the tips generally include a precious metal (PM) material secured to a base material. Unfortunately, in the past, individual pieces of the PM material was laser welded onto the base material of each tip. This requires expensive tooling and product specific fixturing equipment to hold the individual pieces of PM material during the laser welding process. Due to the complexity of the ground electrode geometry, the manufacturing of the pre-chamber spark plug tends to be a tedious, time consuming, and expensive process. Further, due to the potential for error or improper manufacturing due to the need to fixture the individual pieces of PM material to the base material portion of the tips, the prior processes result in less reliable or robust ground electrodes.

There is a need, therefore, for improvements in methods of manufacturing pre-chamber spark plugs and particularly ground electrodes for pre-chamber spark plugs that overcome one or more of the above identified problems existing in the art. Embodiments of the present invention provide such improved methods.

BRIEF SUMMARY OF THE INVENTION

Embodiments of the present invention provide new and improved methods of forming a ground electrode. More particularly, embodiments of the present invention provide a new and improved method of forming a ground electrode that includes a contact portion formed of a different material than a base material secured to the base material. The new and improved method reduces the need to fixture, with external fixturing apparatuses, the different material to a support portion of the base material.

In a particular implementation of the invention, the method of forming the electrode includes forming a first locating hole in a blank of a base material. Also, the method includes inserting a rod of a second material into the first locating hole. The rod is brazed to the base material within the locating hole. Finally, the base material is machined such that a surface of the rod of the second material is exposed. Typically, the machining to expose the surface of the rod forms an annular base portion and support portion out of the base material. The rod being secured to a distal end of the support portion. Further, the annular base portion defines an electrode receiving aperture through which a second electrode, i.e. a charged electrode may extend when assembled into a finished spark plug.

When forming an electrode that includes a plurality of spark surfaces, i.e. includes a plurality of contact portions, the method further includes forming a plurality of locating holes in the blank of base material; inserting a plurality of rods of the second material into the plurality of locating holes, wherein a single rod is inserted into each locating hole; brazing the plurality rods to the base material; and machining the base material such that a surface of each of the rods is exposed by removing away the base material that surrounds the rods when inserted into the locating holes.

In preferred implementations, the locating holes and machining of the blank of base material is performed by wire EDM and thus the step of forming a plurality of locating holes includes inter-connecting the plurality of locating holes such that the wire EDM process need not be continually started and stopped. It can be a continuous cut forming all locating holes. The use of wire EDM also allows the machining of complex shapes and holes for different shaped rods and ultimate contact portions.

Further, the blank and the rods are preferably much longer in an axial direction than a single electrode such that after the rods are secured to the base material, the blank is section cut into a plurality of individual and substantially identical electrodes. In some methods, the blank of base material has a length of between about 1 inch and 2 inches and the individual electrodes, after being section cut, have a length of between about 0.1 inch and 0.2 inches.

To provide a clean virgin sparking surface by the contact portion (i.e. rods) the step of machining an electrode receiving aperture includes machining away a portion of the second material (i.e. material of the rod) to expose a clean surface of the second material. Thus, in most implementations, the step of machining the electrode receiving aperture is performed after the step of brazing.

The step of machining an electrode receiving aperture includes, in some embodiments, forming an annular base portion out of the base material and a support portion that extends radially inward from the annular base portion, the rod of second material being connected to the support portion with the support portion being radially interposed between annular base portion and the rod of the second material.

Due to the use of the locating holes, the step of inserting a rod of the second material into the first locating hole substantially locates the rod relative to the base material in at least two dimensions. This prevents the need to provide separate fixturing of the rod in those dimensions. These two dimensions are in the non-axial direction (i.e. the direction in which the locating holes are formed. Thus, the method may further comprise the step of spot welding an end of the rod to an end of the blank of base material to secure the second material in a third dimension generally perpendicular to the at least two dimensions.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
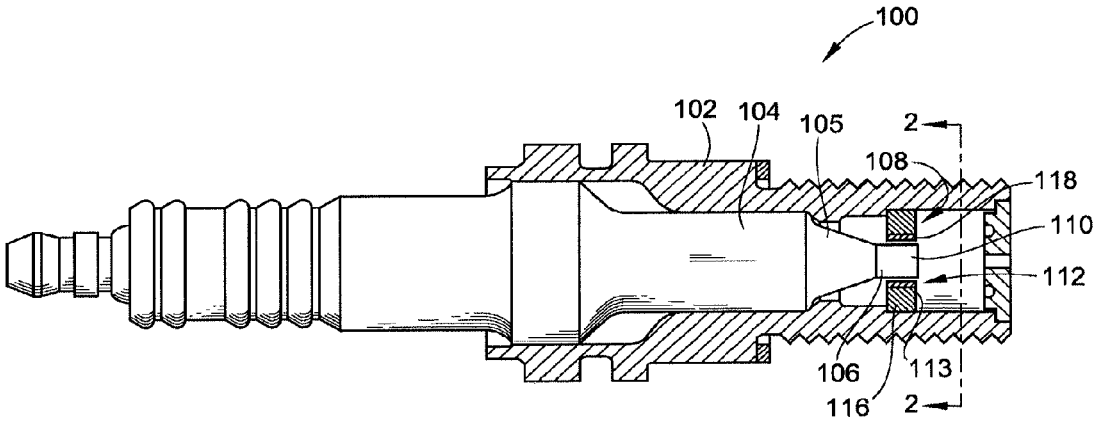
FIG. 1 is a cross-sectional illustration of a spark plug constructed in accordance with an embodiment of a method of the present invention.
Figure 2:
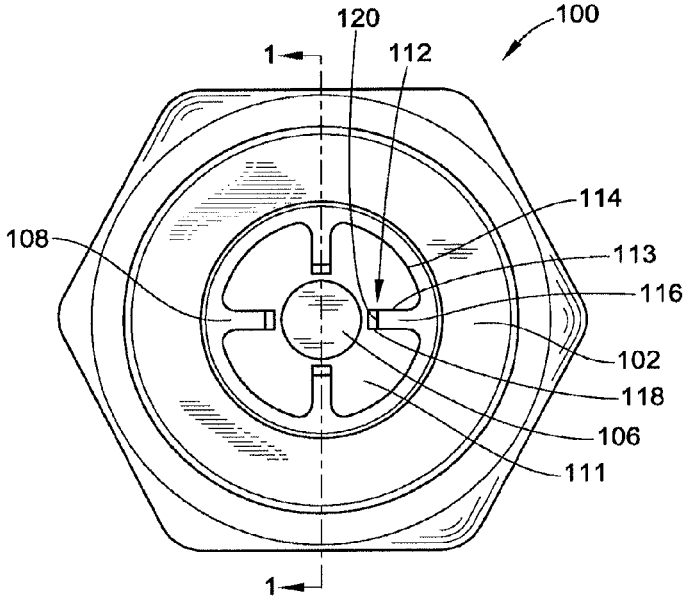
FIG. 2 is a simplified end-view illustration of the spark plug of FIG. 1.

FIG. 1 is a partial cross-sectional illustration and FIG. 2 is an end view illustration of a pre-chamber spark plug 100 (also referred to as "spark plug 100") constructed in accordance with a method of the present invention. Pre-chamber spark plugs, and particularly spark plugs in general, are known in the art, so a detailed description of the conventional portions of the pre-chamber spark plug 100 need not be described in detail herein. However, the following description of FIGS. 1 and 2 will highlight unique structures the manufacture of which is improved through the embodiments of the methods of the present invention.

The spark plug 100 includes a cylindrical shell 102 and an insulator 104 that is fitted into the shell 102. The shell 102 is typically formed from metallic material such as low-carbon steel. A center electrode 106 (also referred to as a charged electrode) is disposed inside the insulator 104 such that a portion at a tip portion 105 projects from the insulator 104.

In a conventional spark plug, a ground electrode is used wherein one end is joined to the shell through, for example, welding and whose opposite end is bent laterally such that a side face thereof faces a tip portion of the center electrode. Unlike a conventional spark plug, the ground electrode 108 of the present invention is generally annular or otherwise disc-like and is mounted proximate the end 110 of the center electrode 106. A spark gap 112 is formed between the ground electrode 108 and the center electrode 106. The center electrode 106 extends through the aperture 111 defined by the ground electrode 108 such that the center electrode 106 is surrounded by ground electrode 108.

The ground electrode 108 includes a plurality of tips 113 that define spark gaps 112. The spark that is generated between the ground electrode 108 and center electrode 106 is initiated between tips 113 and center electrode 106 within spark gap 112. In the illustrated embodiment, the ground electrode 108 generally includes an annular base portion 114 from which the tips 113 extend radially inward. Each tip 113 includes a support portion 116 that supports a contact portion 118. The support portion 116 is typically formed as a one-piece construction with base portion 114. To be a one-piece construction, the structure must be a continuous structure not formed from a plurality of separate components secured together. Thus, for example, the one-piece construction could be formed by machining from a single blank of material or a one-step molding process or alternatively from a continuous extruding process.

The ground electrode 108 is typically secured, such as by welding or brazing, to the outer shell 102.

To improve spark generation, the contact portions 118 are formed from a different metal material than the base or support portions 114, 116. Typically, the base and support portions 114, 116 are formed from a non-precious metal such as Nickel-200. The contact portion 118 is preferably formed from a precious metal (PM) material such as an Iridium alloy rod. Other precious metal materials include alloys made from metals that are in the noble metal family, including but not limited to: Platinum, Rhodium, Gold, Iridium, Osmium, Palladium, Rhenium, Ruthenium, Silver, etc. or other metals that are corrosion resistant and have good conductivity.

As noted previously, individual pieces or pins of PM material contact portions 118 have often been welded to the support portions 116 after the base and support portions 114, 116 have been machined to final form. This requires fixturing the contact portions 118 to the distal ends 120 of the support portions 116 and then laser welding the contact portions 118 thereto. Again, because it was very difficult to secure the contact portions proximate distal ends 120, this provided for difficult, complex, costly and low reliability in manufacturing the discharge electrodes.

Embodiments of the present invention relate to improved methods of forming a ground electrode 108 that includes the PM material contact portions 118.

Figure 3:
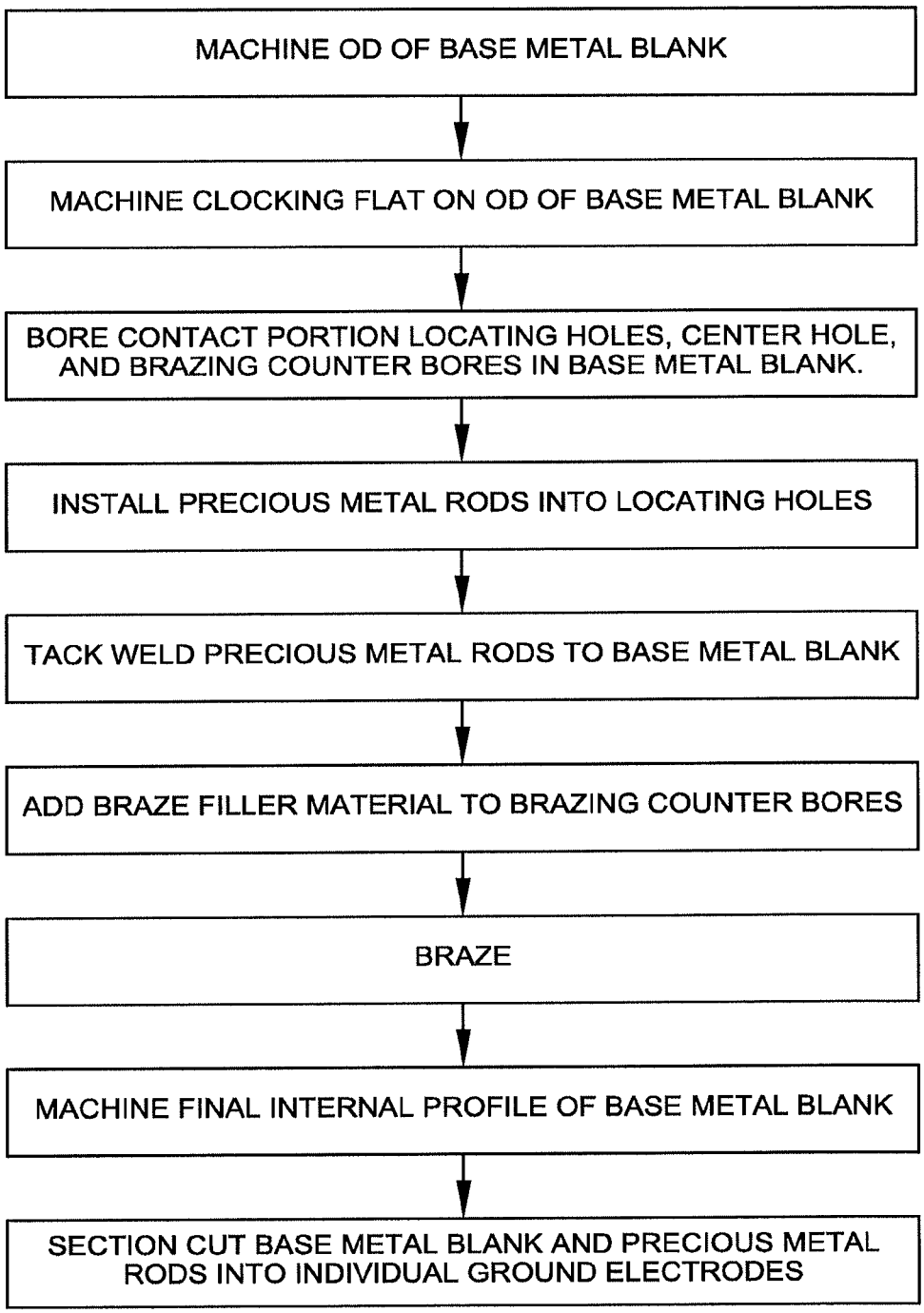
FIG. 3 is a flow chart illustrating the steps in performing a preferred method of forming an electrode for a spark plug according to the present invention.

The following discussion will outline a preferred method of forming the ground electrode 108. FIG. 3 provides a flow chart of the various steps in forming the ground electrode 108. The identified steps are provided for a preferred embodiment of the method of manufacturing. However, other methods are contemplated that may include more or less steps and that perform the steps in a different order. Thus, the invention is not limited to the exact steps and arrangement of steps as presented in the preferred method of FIG. 3.

The preferred method will also be described with reference to FIGS. 4-10, which are end-view and cross-sectional illustrations of various steps in the manufacturing process for forming a ground electrode having rounded contact portions. However, the ground electrode 108 of FIG. 2 may also be referenced during this description.

Figure 4:
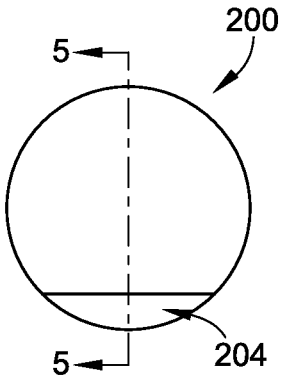
FIGS. 4-10 are end view and cross-sectional illustrations of the parts of the electrode as the electrode is being formed using the method of FIG. 3.
Figure 5:
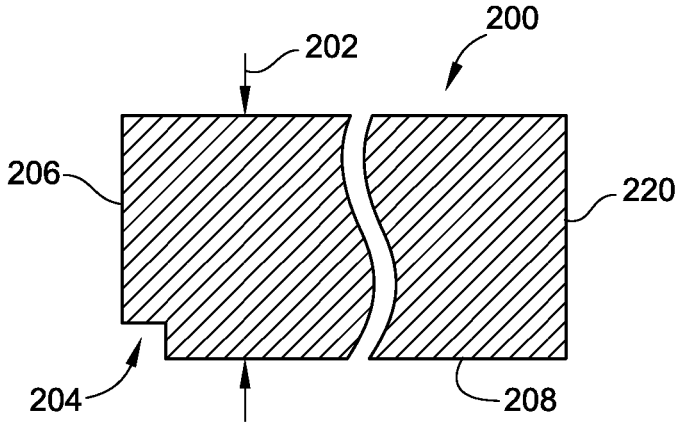
Figure 6:
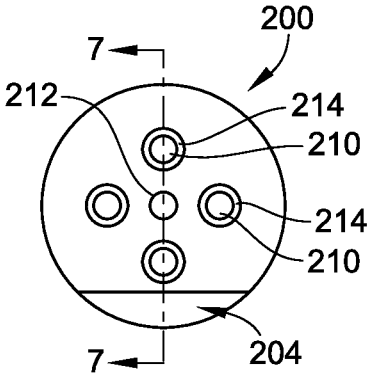
Figure 7:
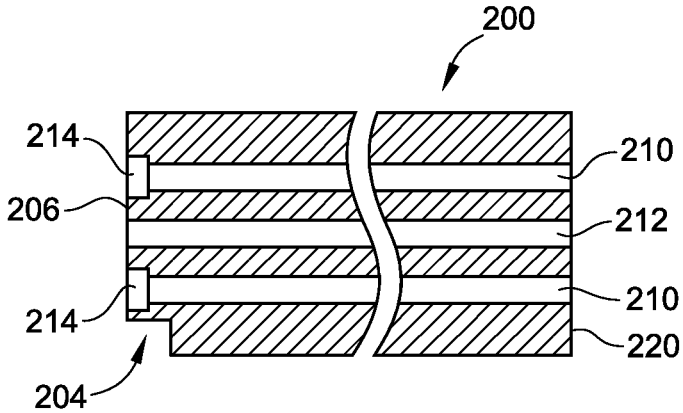
Figure 8:
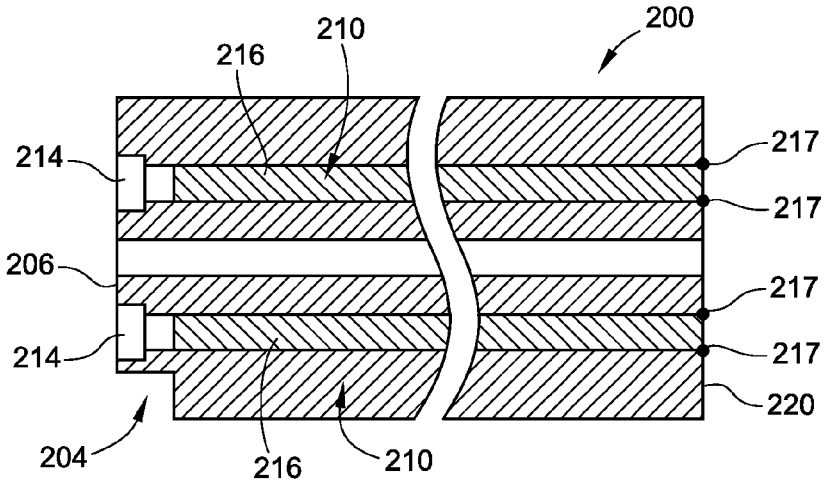
Figure 9:
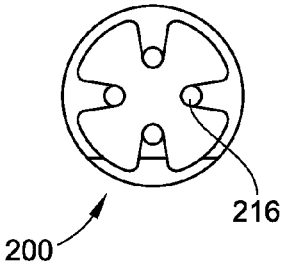
Figure 10:
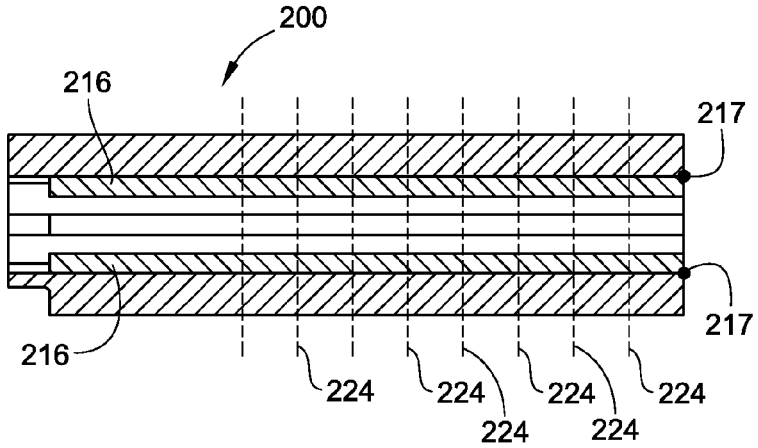
Figure 11:
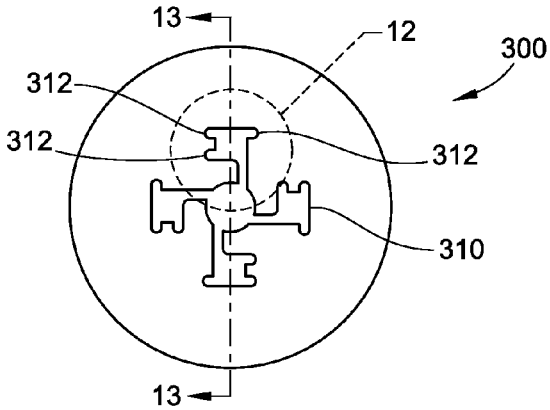
FIGS. 11-15 are end view and cross-sectional illustrations of the parts of the electrode of another embodiment as the electrode is being formed using the method of FIG. 3.
Figure 12:
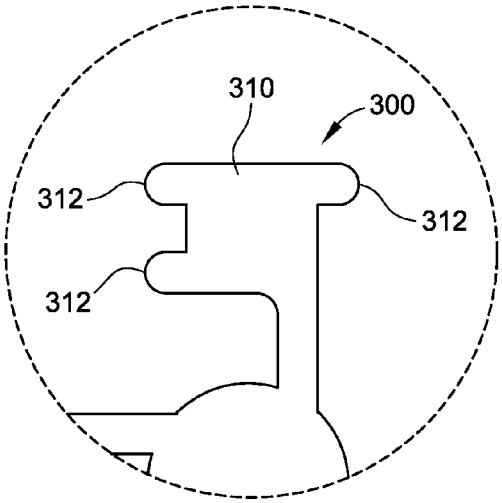
Figure 13:
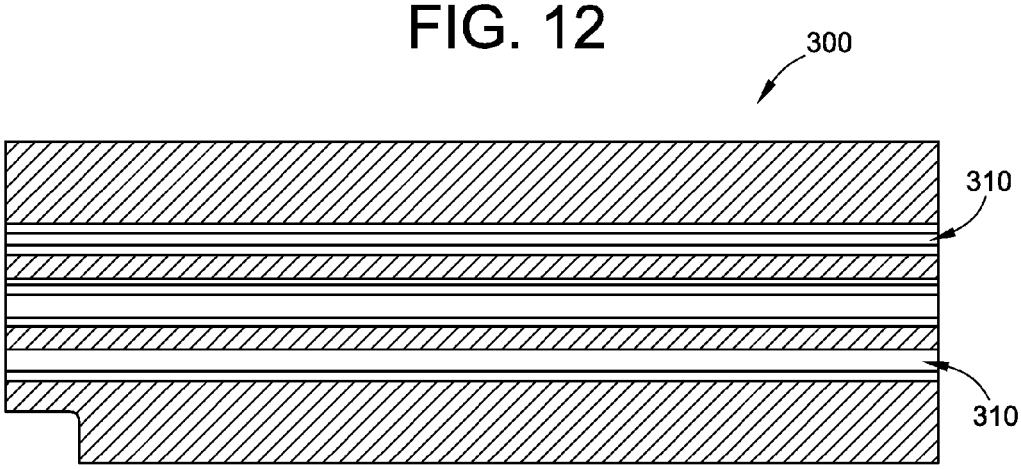
Figure 14:
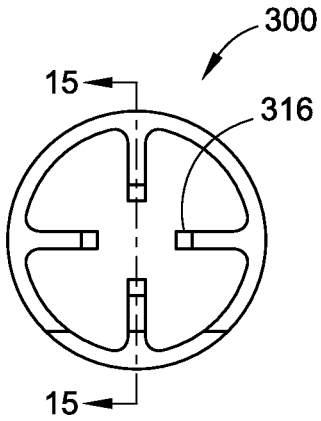
Figure 15:
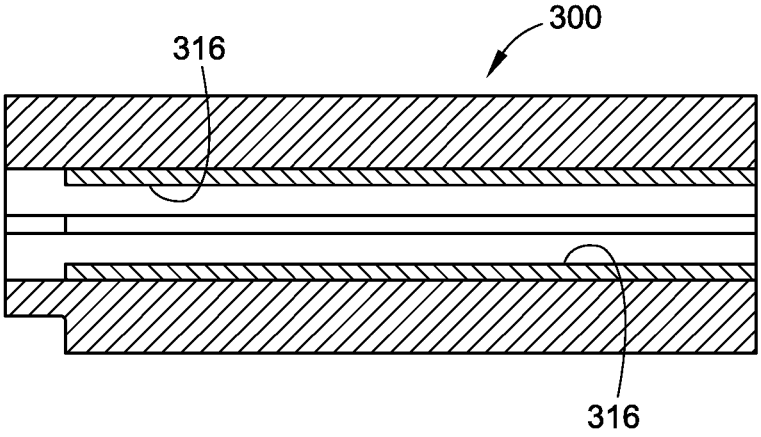

The method begins with a continuous blank 200 of base material, typically in a cylindrical rod form as illustrated in FIGS. 4 and 5. The outside diameter 202 of the blank 200 is then machined to the desired finished outside dimension of the base portion 114 of the ground electrode 108. This outside dimension is closely sized to the inside diameter of a corresponding shell of a spark plug, such as shell 102 discussed previously.

A clocking flat 204 is then machined into one end of the blank 200. The clocking flat 204. The clocking flat 204 intersects end 206 of the blank 200 as well as the outer cylindrical surface 208 of the blank 200. The clocking flat 204 provides a known point for locating the blank 200 during subsequent machining processes to increase tolerancing of the manufacturing process.

After initial machining of the blank 200, locating holes 210 are then machined axially through the blank 200 (see FIGS. 6 and 7) Along with the locating holes 210, in some embodiments a center hole 212 to assist and facilitate future machining processes is formed. Further, in alternative embodiments, such as for the embodiment illustrated in FIGS. 11-15, the holes may all be formed by a single hole, but be inter-connected with one another, such that in actuality only a single hole or aperture is formed axially through the blank 200. However, a plurality of locating holes will be considered to be provided, as identified by reference numeral 310 because these locating holes 310 will be used for locating the PM material during subsequent processes. This machining is typically done by a wire EDM process.

In additional to forming the locating holes 210 that preferably extend axially all the way through the axial length of blank 200, in at least one end of the blank 200, a plurality of counter bores 214 are formed in the end 206 of the blank 200 aligned with and communicating with locating holes 210. These counter bores 214 will be used for storing or holding brazing material during subsequent brazing operations.

After the locating holes 210 and counter-bores 214 are formed, contact rods 216 are axially inserted into the locating holes 210 (see FIG. 8) The contact rods 216 are formed from the desired material, such as a PM material or other high-spark initiating material, for forming the contact portions, such as for instance contact portions 118.

With the contact rods 216, inserted into the locating holes 210, the contact rods 216 are preferably tack welded with tack welds 217 to the blank 200 to prevent axial movement of the contact rods 216. The spot welding may be done by any method of welding and is typically performed in end 220 of the blank 200, opposite, end 206 that includes the counter bores 214. There is no need to correlate the end that includes the clocking flat 204 with the end that includes either or both of the tack welds or the counter bores 214.

Typically, the parts are dimensioned such there is a clearance between the locating holes 210 and the contact rods 216. For example only, in one embodiment using round contact rods 216, the outer diameter of the contact rod may be between 0.049-0.051 inches while the inner diameter of the locating holes 210 may be between 0.052-0.054 inches. This clearance will provide a future path way for future brazing material to flow during a future brazing process. This clearance of at least 0.001 inch also assists in installing the contact rods 216 within the locating holes 210.

Once the contact rods 216 are secured within blank 200, the counter bores 214 are filled with braze filler material (not shown).

Next, the contact rods 216 are brazed to the blank 200. Typically, this brazing process can be performed using standard brazing procedures. Preferably, however, the brazing operation is performed by vacuum brazing to provide a strong uniform joint between the contact rods 216 and the blank 200. The braze filler material will flow through the clearance identified above and be interposed between the base material provided by blank 200 and the PM material provided by contact rods 216.

Desirable braze filler materials include, but are not limited to, AMS-4787, AMS 4786, AMS-4784, AMS-4777, AMS-4776, AMS-4779, AMS-4778, AMS-4782, AMS-4775, as well as any other nickel based, gold based, silver based or copper based braze filler material or alloy.

Once, the brazing process is complete and the contact rods 216 are secured to the blank 200, the combined structure is further machined. More particularly, the internal profile of the ground electrode is machined into the blank 200. For illustrative purposes, with reference to ground electrode 108 of FIG. 2, the base and support portions 114, 116 are machined into the blank 200. Preferably, during this machining step, the outer surface of the contact rods 216 (i.e. contact portions 118) are slightly machined so as to provide a clean virgin outer surface 222 on the contact rods 216. This removes any brazing material or other impurity that may be adhered to the exposed outer surface of the contact rods 216 to provide a clean contact portion 118.

After the internal profile (i.e. aperture 111 in FIG. 2 for example has been machined, the blank 200 is then section cut at desired axial locations 224 forming individual ground electrodes from the blank 200. Typically, the individual axial lengths are about 0.100-0.110 inches and more preferably about 0.103-0.107 inches. In a desired method, the length of the blank 200 is preferably between about 1.0 and 2.0 inches such that about eight (8) to about eighteen (18) ground electrodes can be formed from a single blank 200. However, other lengths of blank 200 could be used. However, it is desirable to keep blank 200 to a reasonable length so as to be able to maintain accurate machining of locating holes 210 as well as to permit sufficient flow of brazing filler material between the blank 200 and contact rods 216.

It should be understood that this new process provides a significant advantage over the prior methods of machining the base material of the ground electrode, including the base portion and the support portions, and then trying to attach the contact portion to the distal end of the support portion. Here, there is no fixturing required to hold the contact rods 216 during the process of securing the PM material to the base material. Instead, the contact rods 216 are fully secured, i.e. fixtured, by the base material blank 200 itself. Thus, this method is highly repeatable and provides significant improvements in reliability in the manufacturing process. It also reduces the need for complex fixturing apparatuses.

FIGS. 11-15 provide various cross-sectional illustrations for forming a further embodiment of a ground electrode formed using an embodiment of the method according to the present invention. The steps of forming this embodiment are substantially similar to the previous method but are configured to mount a square contact rod to a blank of base material. The sequence of these figures would be used, for example, to form the ground electrode of FIG. 2.

After beginning with the initial outside machining and machining of the clocking flat, as illustrated in FIGS. 4 and 5, locating holes 310 are machined into blank 300. In this embodiment, all of the locating holes 310 are interconnected with one another such that in actuality only a single aperture passes axially through blank 300. However, due to the inner profile of the aperture, a plurality (four) locating holes 310 are formed in the blank. These locating holes 310 are configured to fixture a corresponding shaped contact rod, i.e. square in this embodiment. The locating holes 310 must be configured to properly orient and prevent movement of the corresponding contact rod so as to maintain proper tolerancing and adequate brazing during a subsequent process.

To facilitate the brazing process, each of the locating holes 310 include brazing material flow channels 312. During the brazing process, these brazing material flow channels 312 will allow the brazing material to flow axially within the blank 300 to provide a more consistent braze of the contact rod 316 to the base material of the blank 300 along the entire axial length of blank 300. Even with the use of flow channels 312, it is desirable that there is some clearance between the outer dimensions of the contact rods 316 and the corresponding inner dimensions of the locating holes 310 so as to promote easier installation of the contact rods 316 and flow of brazing filler material between the contact rods 316 and base material of blank 300.

Other shaped contact rods can be used, and the two illustrated embodiments (FIGS. 4-10 and FIGS. 11-15) illustrate this ability to provide contact rods having different profiles. For instance, a contact rod could have cross-sectional profiles that are triangular, rectangular, polygonal, hemispherical (½ round), oblong, elliptical, crescent shaped, bezel strip, tubing, low dome, helical, etc. and the present invention is not limited to any particular shape.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of forming an electrode for a spark plug including a base material and a second material different than the first material mounted thereto, the method comprising the steps of:

forming a first locating hole in a blank of base material;

inserting a rod of the second material into the first locating hole;

brazing the rod of the second material to the base material; and machining an electrode receiving aperture in the blank of base material such that a surface of the rod of the second material is exposed.

2. The method of claim 1 further comprising the step of forming a plurality of locating holes in the blank of base material; inserting a plurality of rods of the second material into the plurality of locating holes, wherein a single rod is inserted into each locating hole; brazing the plurality of rods to the base material; and machining the electrode receiving aperture in the blank of base material such that a surface of each of the rods is exposed.

3. The method of claim 2, further wherein the step of forming a plurality of locating holes includes inter-connecting the plurality of locating holes.

4. The method of claim 2, wherein the steps of forming the first locating hole and the step of machining an electrode receiving aperture are performed using wire EDM.

5. The method of claim 2, further comprising the step of section cutting the blank of base material into a plurality of individual electrodes.

6. The method of claim 5, wherein the blank of base material has a length of between about 1 inch and 2 inches and the individual electrodes have a length of between about 0.1 inch and 0.2 inches.

7. The method of claim 2, wherein the step of machining an electrode receiving aperture includes machining away a portion of the second material to expose a clean surface of the second material.

8. A method of forming an electrode for a spark plug including a base material and a second material different than the first material mounted thereto, the method comprising the steps of:

forming a first locating hole in a blank of base material;

inserting a rod of the second material into the first locating hole;

brazing the rod of the second material to the base material;

machining an electrode receiving aperture in the blank of base material such that a surface of the rod of the second material is exposed; and wherein the step of machining an electrode receiving aperture includes forming an annular base portion out of the base material and a support portion that extends radially inward from the annular base portion, the rod of second material being connected to the support portion with the support portion being radially interposed between annular base portion and the rod of the second material.

9. The method of claim 1, wherein the step of inserting a rod of the second material into the first locating hole substantially locates the rod relative to the base material in at least two dimensions.

10. The method of claim 9, further comprising the step of spot welding an end of the rod to an end of the blank of base material to secure the second material in a third dimension generally perpendicular to the at least two dimensions.

11. The method of claim 1, wherein the step of machining an electrode receiving aperture in the blank of base material is performed after the step of brazing the rod of the second material to the base material.

12. A method of forming an electrode for a pre-chamber spark plug, the method comprising the steps of:

forming a plurality of locating holes in a blank of non-precious material;

inserting a rod of a precious metal (PM) material into each of the locating holes;

brazing the rod of the PM material to the blank of non-precious material;

machining an electrode receiving aperture in the blank of non-precious material such that a surface of the rod of the PM material is exposed.

13. A method of forming an electrode for a pre-chamber spark plug, the method comprising the steps of:

forming a plurality of locating holes in a blank of non-precious material;

inserting a rod of a precious metal (PM) material into each of the locating holes;

brazing the rod of the PM material to the blank of non-precious material;

machining an electrode receiving aperture in the blank of non-precious material such that a surface of the rod of the PM material is exposed; and machining an outside diameter of the blank of non-precious material.

14. The method of claim 12, wherein the step of forming the plurality of locating holes comprises the step of interconnecting each of the plurality of locating holes.

15. The method of claim 12, wherein the steps of forming the plurality of locating holes are performed using wire electrical discharge machining (EDM).

16. The method of claim 1, further comprising the step of section cutting the blank of non-precious material into a plurality of individual electrodes.

17. A method of forming an electrode for a spark plug including a base material and a second material different than the first material mounted thereto, the method comprising the steps of:

forming a first locating hole in a blank of base material;

inserting a rod of the second material into the first locating hole;

brazing the rod of the second material to the base material;

machining an electrode receiving aperture in the blank of base material such that a surface of the rod of the second material is exposed; and machining a clocking flat on an outside of the blank of non-precious material.

18. A method of forming an electrode for a spark plug including a base material and a second material different than the first material mounted thereto, the method comprising the steps of:

forming a first locating hole in a blank of base material;

inserting a rod of the second material into the first locating hole;

brazing the rod of the second material to the base material;

machining an electrode receiving aperture in the blank of base material such that a surface of the rod of the second material is exposed; and tack welding the rod to the blank to hold the rod in position prior to the step of brazing.

19. A method of forming an electrode for a spark plug including a base material and a second material different than the first material mounted thereto, the method comprising the steps of:

forming a first locating hole in a blank of base material;

inserting a rod of the second material into the first locating hole;

brazing the rod of the second material to the base material;

machining an electrode receiving aperture in the blank of base material such that a surface of the rod of the second material is exposed; and forming a plurality of brazing counter bores in an end of the blank of non-precious material communicating with the plurality of locating holes.

20. The method of claim 19, further comprising the step of adding braze filler material to the brazing counter bores prior to the step of brazing.

* * * * *